US006796243B2

(12) United States Patent
Schmees et al.

(10) Patent No.: US 6,796,243 B2
(45) Date of Patent: Sep. 28, 2004

(54) CARTRIDGE

(75) Inventors: Heiner Schmees, Celle (DE); Lothar Post, Korschenbroich (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

(21) Appl. No.: 10/395,174

(22) Filed: Mar. 25, 2003

(65) Prior Publication Data

US 2003/0209162 A1 Nov. 13, 2003

(30) Foreign Application Priority Data

Mar. 26, 2002 (DE) ..... 102 13 465

(51) Int. Cl.[7] ..... F42B 5/08; F42B 5/295; F42B 5/30

(52) U.S. Cl. ..... 102/472; 469/467; 469/431

(58) Field of Search ..... 102/472, 470, 102/469, 467, 433, 431

(56) References Cited

U.S. PATENT DOCUMENTS 5,287,791 A * 2/1994 Chaboki et al. ..... 102/472
5,503,081 A * 4/1996 Lindblom et al. ..... 102/472
6,644,204 B2 * 11/2003 Pierrot et al. ..... 102/472

FOREIGN PATENT DOCUMENTS

| | | | |
|---|---|---|---|
| DE | 23 55 221 | A | 5/1995 |
| DE | 199 36 649 | A1 | 11/2000 |
| EP | 001258695 | A1 * | 11/2002 |
| FR | 2 197 155 | A | 3/1974 |
| GB | 2 349 939 | A | 11/2000 |
| WO | WO 96 29565 | | 9/1996 |
| WO | WO 00 17598 | | 3/2000 |

* cited by examiner

*Primary Examiner*—Michael J. Carone
*Assistant Examiner*—James S. Bergin
(74) *Attorney, Agent, or Firm*—Venable LLP; Stuart I. Smith

(57) ABSTRACT

A cartridge having a propellant-charge casing (2) and an electrothermal ignition device (4), in which the propellant-charge casing (2) is connected to a metal casing base (3) and a contact piece (5) that is connected to a contact disk (9) is provided for the connection to a gun-side high-voltage electrode (22. To assure an automatic operation of corresponding weapons systems, during use of such cartridges, the contact piece (5) is formed such that it does not protrude past the outside surface (27) of the floor piece (7) on the outside, and on the inside, the contact piece forms the contact disk (9), which is supported over a large surface area against the propellant-charge casing (2) by a relatively thin-walled insulator (15) that is formed as a casing base.

7 Claims, 4 Drawing Sheets

CARTRIDGE

BACKGROUND OF THE INVENTION

The invention relates to a cartridge having a propellant-charge casing and an electrothermal ignition device, with the propellant-charge casing being connected to a metal casing base.

In these known cartridges, the propellant-charge powder is ignited through the formation of arc discharges inside the propellant-charge powder of the respective cartridge. To this end, at least one wire conductor is located inside the propellant-charge powder of the respective cartridge. To ignite the powder, a high current flows through the conductor, causing the corresponding wire to vaporize explosively. The light arc formed in this process then ignites the surrounding propellant-charge powder.

A cartridge of this type is known from, for example, DE 199 36 649 A1, Here, a well-insulated electrical contact piece is guided through the metallic casing bottom or floor, the piece protruding far beyond the outside of the floor or bottom piece of the casing base and being contacted by a high-voltage electrode on the side of the gun. Inside the casing base, the contact piece is supported laterally by a fairly solid insulating molded part, and is connected to a contact disk, to which a plurality of wire conductors that are led through the propellant-charge powder are secured.

One drawback of this known cartridge is that the contact piece protruding on the outside cannot be used to implement an automatic operation of the corresponding weapons system, particularly with wedge-type breechblocks. Moreover, the solid, insulating molded part that supports the contact piece occupies a relatively large amount of space inside the cartridge, which is counter to the requirement of a high charge density of the propellant-charge powder.

It is the object of the invention to provide a cartridge that can be produced simply, and permits an automatic operation of weapons systems, as is also fundamentally possible in the use of conventional cartridges.

SUMMARY OF THE INVENTION

This object generally is achieved according to the present invention, by a cartridge having a propellant-charge casing and an electrothermal ignition device, with the propellant-charge casing being connected to a metal casing base having an opening in the bottom of the base, and having an insulating layer disposed in the casing base and resting in a form-fit against an entire inside surface of the casing base and forming a casing floor. The insulating layer has an annular portion that protrudes into the opening of the casing base, with the annular portion having an outer surface supported against an inside wall of the base bottom defining the opening. An electrical contact piece is disposed in and surrounded by the annular portion of the insulating layer and protrudes from the inside of the casing base to enable electrical contact by a high-voltage electrode from an exterior of the casing base. The electrical contact piece is connected in one piece to a contact disk, which rests in a form-fit against the insulating layer formed as a casing floor, and is connected to ignition wires of the electrothermal ignition device. Further especially advantageous embodiments of the invention are disclosed.

The invention is essentially based on the concept of forming the contact piece such that it does not protrude past the front surface of the floor or bottom piece on the outside, and on the inside, it forms the contact disk, which is supported over a large surface area against the propellant-charge easing by a relatively thin-walled insulator that is formed as a cartridge floor, so a correspondingly solid, insulating molded part can be omitted.

The cartridge according to the invention, in which the insulation of the high-voltage-conducting parts are completely integrated into the casing base, is especially well suited for modern tank cannons having a wedge-shaped breechblock.

Whereas, in the cartridge known from DE 199 36 649 A1, parts of the weapons-system breechblock are also required for supporting the electrode and the insulator under gas pressure (i.e., during firing), in the cartridge of the invention, the electrode and the insulator are completely supported by the casing base of the cartridge.

It has proven advantageous for the outer edge of the contact disk to be formed as a sealing lip, so powder gases are prevented from traveling between the insulator and the contact disk during firing.

For securing the contact disk, it is possible to glue the disk to the insulator and then glue the insulator to the casing base.

In a further advantageous embodiment of the invention, the sealing lip of the casing base and the insulator are formed in one piece. In this case, the process of vulcanizing the insulating layer simultaneously produces the connection (adhesion) to the casing base and the contact disk. As has been seen, this method is well suited for mass production of the cartridge of the invention.

Further details about and Advantages of the invention ensue from the exemplary embodiments explained below in conjunction with figures.

Figure 1:
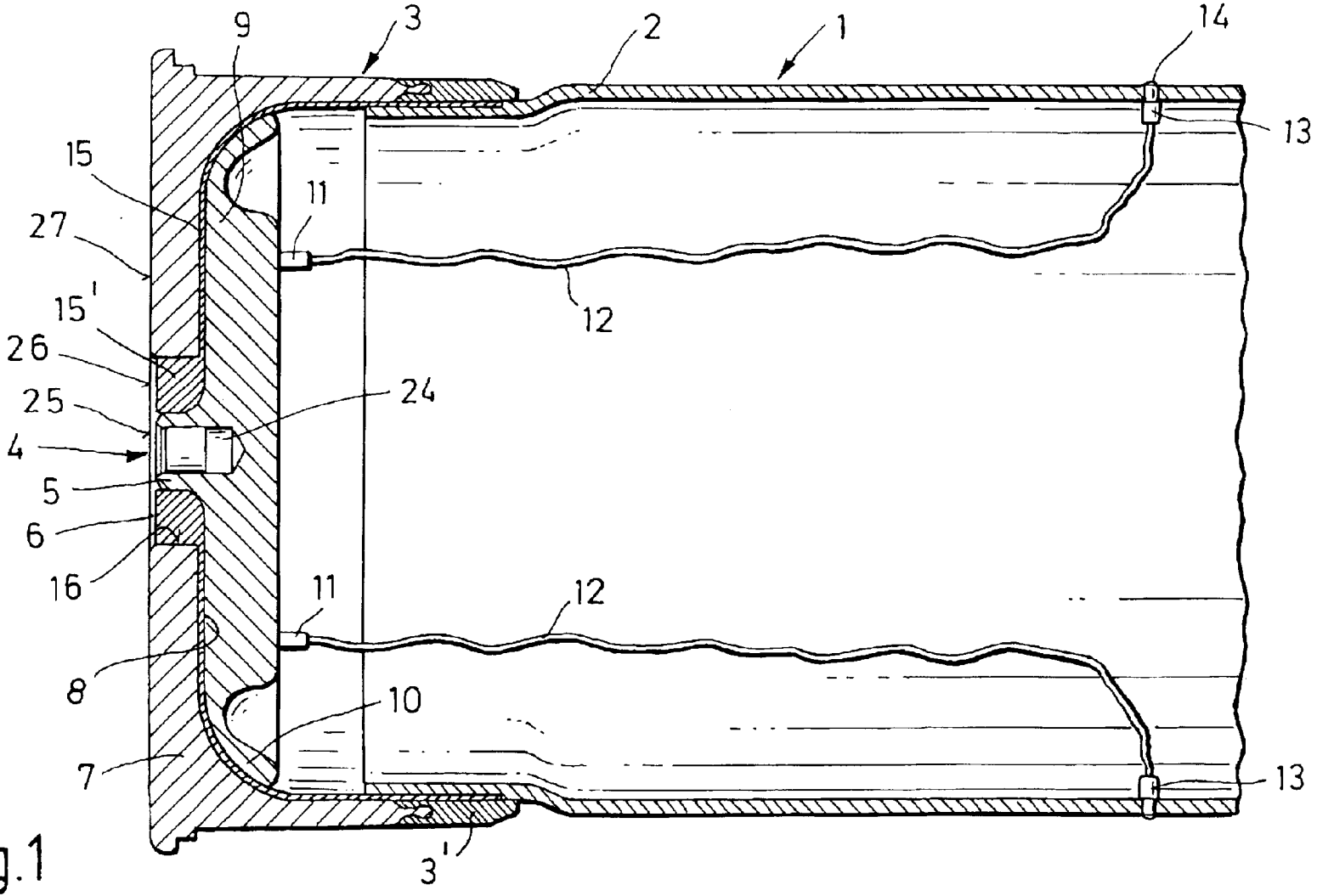
FIG. 1 is a longitudinal section through a casing-base-side region of a cartridge according to the invention.

DETAILED DESCRIPTION OF THE INVENTION,

In FIG. 1, a large-caliber cartridge (e.g., for firing from a tank gun) represented by 1 has a combustible propellant-charge casing 2 and a metal casing base 3 with an annular sealing lip 3' secured to its front.

The cartridge 1 is provided with an electrothermal ignition device 4. This device essentially comprises an electrical contact piece 5, which protrudes into a central recess or opening 6 in the floor or bottom 7 of the casing base 3, and is connected to a large-surface contact disk 9 that extends over the entire inside surface a of the floor or bottom 7. The contact disk 9 has a sealing lip 10 at its outer edge. Respective ends 11 of two wires 12 that serve to ignite light arcs are also secured to the contact disk 9. The respective other ends 13 of the two wires 12 are secured to a contact ring 14 of the propellant-charge casing 2.

The contact disk 9 and the casing base 3 are electrically insulated from one another by a high-voltage-proof insulator or insulating layer 15 formed as a casing floor. Inside the recess 6 of the bottom 7, insulating layer 15 forms an annular region 15' that extends into the recess or opening 6 and is supported on the outside against the inside wall 16 of the floor 7 that defines the recess 6. The annular region 15' of the insulator 15 also surrounds the contact piece 5 protruding into the recess 6. The contact piece 5 is provided with an axial recess 24.

As can be seen from FIG. 1, both the outer end 25 of the contact piece 5 and the outer end 26 of the annular region 15' of the insulator 15 are somewhat set back into the recess 6 in comparison to the outer surface 27 of the base bottom 7.

Figure 2:
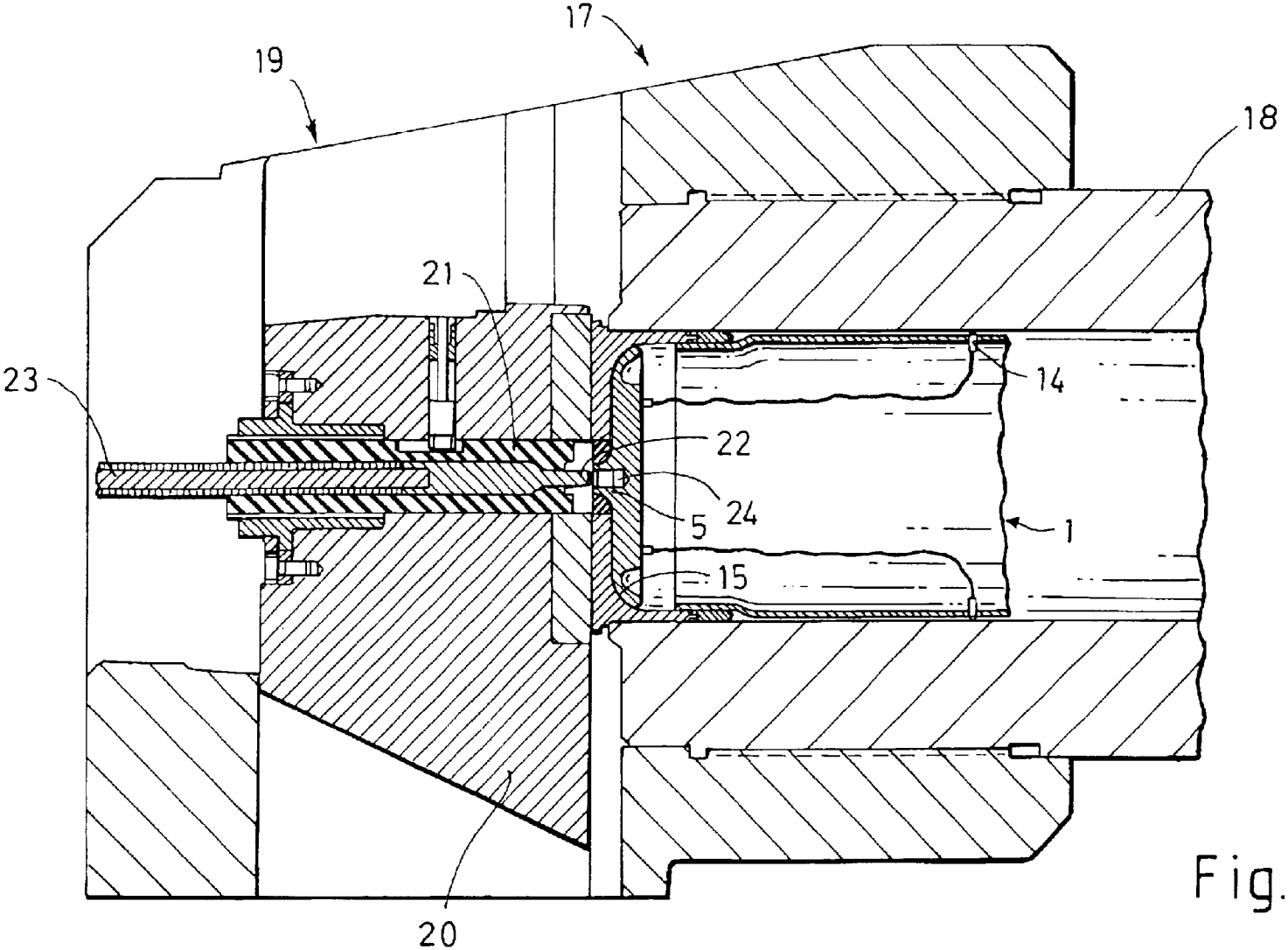
FIGS. 2 and 3 respectively show the arrangement of the cartridge shown in FIG. 1 in a gun having a wedge-shaped breechblock, before and after the electrical contact of the cartridge has been contacted.
Figure 3:
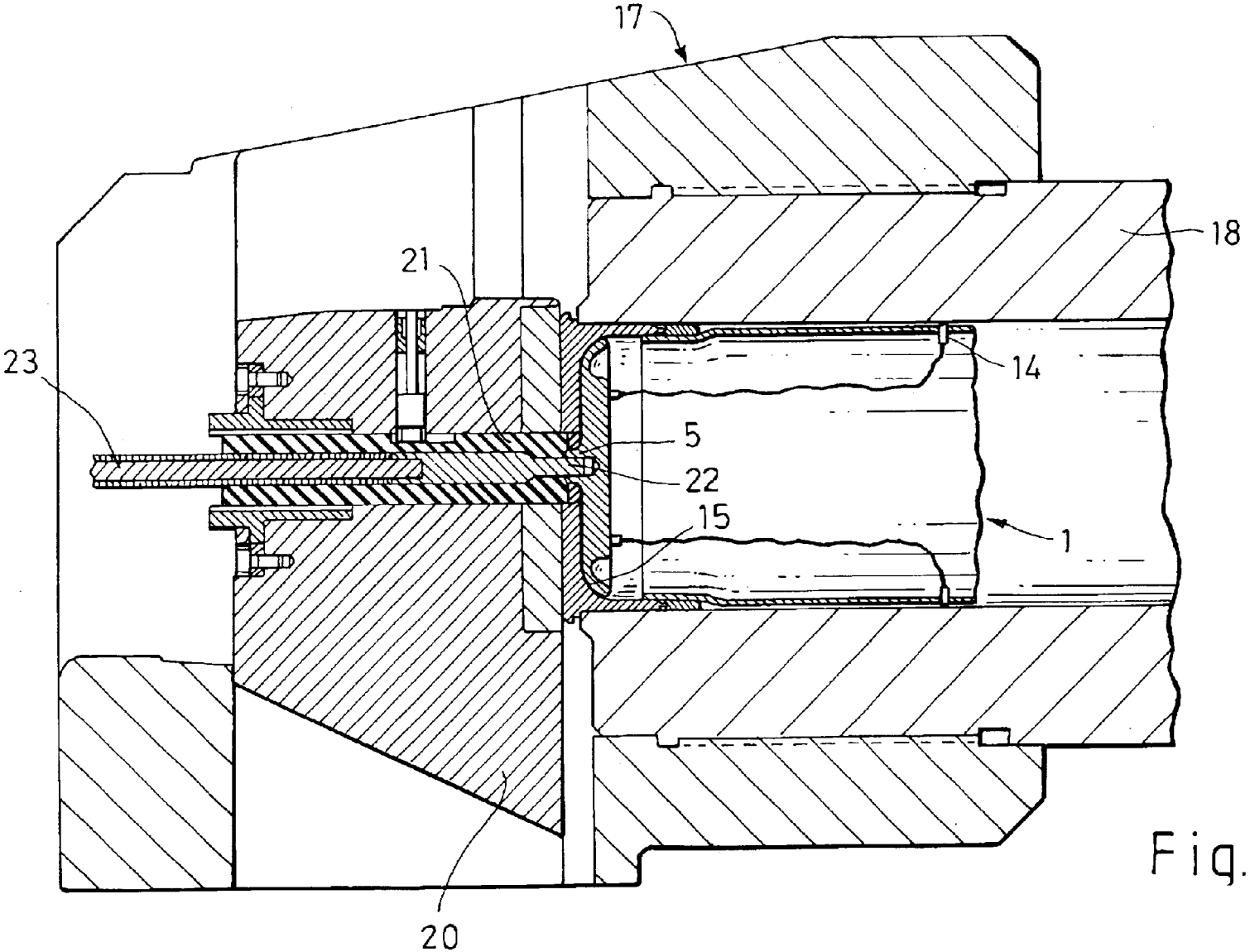

FIGS. 2 and 3 illustrate the breechblock-side region of a tank cannon 17 with a loaded cartridge 1. Here, a gun barrel 18 and a breech ring 19 are visible. A wedge-shaped breechblock having a breechblock wedge 20 is located in the breech ring 19. Disposed in the breechblock wedge 20 is an axially displaceable high-voltage electrode 22, which is surrounded by an insulating piece 21. A line 23 connects the electrode 22 to a current source, not shown.

After the breechblock wedge 20 has been closed (FIG. 2), the high-voltage electrode 22 is automatically displaced in the direction of the contact piece 5 of the cartridge 1, and pressed forward into the axial recess 24 of the contact piece 5 (FIG. 3). At the same time, the insulating piece 21 of the high-voltage electrode 22 presses against the annular region 15' of the insulator 15 of the cartridge 1, so the electrical connection between the high-voltage electrode 22 and the contact piece 5 is completely insulated.

Of course, the invention is riot limited to the illustrated embodiment. For example, both the outer end 25, of the contact piece 5 and the outer end 26 of the annular region 15' of the insulator 15 can end flush with the outer surface 21 of the floor 7.

Figure 4:
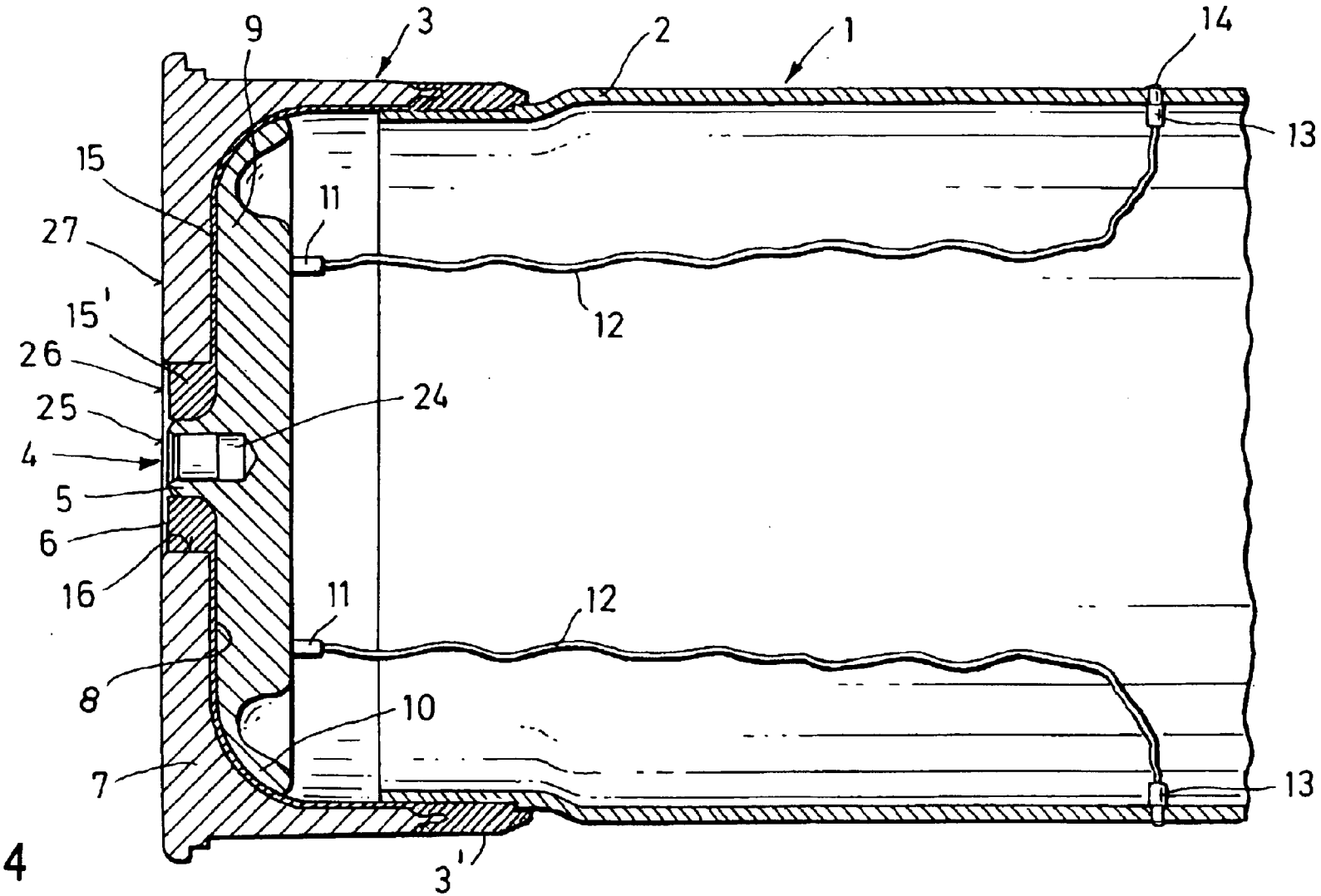
FIG. 4 is a longitudinal section through a casing-base-side region of a cartridge according to an exemplary embodiment of the invention.

In FIG. 4, it has proven especially advantageous for the sealing lip 3' of the casing base 3 to be connected in one piece to the insulator 15. Thus, with the vulcanizing of the sealing lip 3' and the insulator 15, a connection (adhesion) to the casing base 3 and the contact disk 9 can be produced simultaneously in a simple manner.

The invention now being fully described, it will be apparent to one of ordinary skill in the art that many changes and modifications can be made thereto without departing from the spirit or scope of the invention as set forth herein.

What is claimed is:

1. A cartridge comprising:

a propellant-charge casing and an electrothermal ignition device, with the propellant-charge casing being connected to a metal casing base, the casing base having an opening in a bottom of the base and a sealing lip, wherein the sealing lip of the casing base engages the propellant-charge casing;

an insulating layer disposed in the casing base and resting in a form-fit against an entire inside surface of the casing base and having an annular portion that protrudes into the opening of the casing base, with the insulating layer formed as a casing floor, and with the annular portion having an outer surface supported against an inside wall of the base bottom defining the opening, wherein the sealing lip of the casing base and the insulating layer are formed in one piece;

an electrical contact piece disposed in and surrounded by the annular portion of the insulating layer and protruding from an inside of the casing base to enable electrical contact by a high-voltage electrode from an exterior of the casing base; and said electrical contact piece is connected in one piece to a contact disk, which rests in a form-fit against the insulating layer formed as a casing floor, and is connected to ignition wires of the electrothermal ignition device.

2. The cartridge according to claim 1, wherein contact disk extends over the entire inside surface of the bottom of the casing base.

3. The cartridge according to claim 2, wherein the contact disk has a sealing lip at its outer edge.

4. The cartridge according to claim 1, wherein the electrical contact piece has an axially extending recess, into which the high-voltage electrode can be inserted.

5. The cartridge according to claim 1, wherein the opening in the base bottom of the casing base and the annular region of the insulating layer are formed such that, when the electrical contact piece is contacted by the high-voltage electrode, the annular region can be contacted by an insulating piece surrounding the high-voltage electrode.

6. The cartridge according to claim 1, wherein both an outer end of the contact piece and an outer end of the annular region of the insulating layer are one of flush with an outer surface of the casing bottom, and slightly set back into the opening relative to the outer surface of the casing bottom.

7. The cartridge according to claim 1, wherein the opening in the casing bottom leads through the center of the base bottom.

* * * * *